US009651011B2

(12) United States Patent
Romeo

(10) Patent No.: US 9,651,011 B2
(45) Date of Patent: May 16, 2017

(54) VALVE ASSEMBLY FOR AN INJECTION VALVE AND INJECTION VALVE

(71) Applicant: Continental Automotive GmbH, Hannover (DE)

(72) Inventor: Ileana Romeo, Grossetto (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 14/398,997

(22) PCT Filed: May 7, 2013

(86) PCT No.: PCT/EP2013/059499

§ 371 (c)(1),
(2) Date: Nov. 5, 2014

(87) PCT Pub. No.: WO2013/167597

PCT Pub. Date: Nov. 14, 2013

(65) Prior Publication Data

US 2015/0102135 A1 Apr. 16, 2015

(30) Foreign Application Priority Data

May 8, 2012 (EP) ..... 12167049

(51) Int. Cl.
*F02M 51/06* (2006.01)

(52) U.S. Cl.
CPC .... *F02M 51/0632* (2013.01); *F02M 51/0685* (2013.01); *F02M 2200/306* (2013.01)

(58) Field of Classification Search
CPC ..... F02M 51/06; F02M 51/0632; F02M 51/0685; F02M 51/066; F02M 51/0664
(Continued)

(56) References Cited

U.S. PATENT DOCUMENTS 6,367,769 B1 * 4/2002 Reiter ..... F02M 51/0671 239/585.5
6,520,434 B1 * 2/2003 Reiter ..... F02M 51/0685 239/533.11
(Continued)

FOREIGN PATENT DOCUMENTS

DE 19927900 A1 12/2000 ..... F02M 51/06
DE 19950761 A1 4/2001 ..... F02M 51/06
(Continued)

OTHER PUBLICATIONS

European Search Report, Application No. 12167049.1, 5 pages, Nov. 5, 2012.
(Continued)

*Primary Examiner* — Arthur O Hall
*Assistant Examiner* — Joseph A Greenlund
(74) *Attorney, Agent, or Firm* — Slayden Grubert Beard PLLC

(57) ABSTRACT

A valve assembly for an injection valve includes a valve body having a cavity with a fluid inlet portion and a fluid outlet portion, a valve needle axially movable in the cavity between a closing position preventing a fluid flow through the fluid outlet portion and further positions releasing the fluid flow through the fluid outlet portion, an electro-magnetic actuator unit that actuates the valve needle, and includes an axially movable armature in the cavity and a disc element fixedly coupled to the valve needle and configured to limit the axial movement of the armature relative to the valve needle towards the fluid outlet portion. An armature spring biases the armature away from the disc element for establishing a fluid-filled gap between the armature and the disc element. The armature is axially displaceable towards the disc element against the armature spring bias to reduce an axial size of the gap.

19 Claims, 2 Drawing Sheets

(58) Field of Classification Search
USPC ..... 239/584.5, 584.4, 585.5, 584.45
See application file for complete search history.

(56) References Cited

U.S. PATENT DOCUMENTS

| | | | | |
|---|---|---|---|---|
| 6,824,084 | B2 * | 11/2004 | Maier | F02M 51/0671 239/533.11 |
| 7,175,114 | B2 | 2/2007 | Hans | 239/585.1 |
| 7,252,245 | B2 * | 8/2007 | Nishiwaki | F02M 51/0685 239/585.1 |
| 7,721,713 | B2 * | 5/2010 | Hayatani | F02M 51/0685 123/467 |
| 7,753,337 | B2 * | 7/2010 | Suzuki | F02M 51/0625 239/585.1 |
| 8,430,343 | B2 * | 4/2013 | Nagatomo | F02M 51/0685 123/472 |
| 8,857,743 | B2 * | 10/2014 | Shingu | F02M 51/0671 239/585.1 |
| 8,931,718 | B2 * | 1/2015 | Grandi | F02M 51/066 239/585.4 |
| 2002/0020769 | A1 * | 2/2002 | Adachi | F02M 47/027 239/585.1 |
| 2004/0026541 | A1 | 2/2004 | Sebastian et al. | 239/585.5 |
| 2009/0272824 | A1 * | 11/2009 | Kitagawa | F02M 51/061 239/585.5 |

FOREIGN PATENT DOCUMENTS

| | | | | |
|---|---|---|---|---|
| DE | 10345967 | A1 | 4/2005 | F02M 51/06 |
| EP | 1550804 | A1 | 7/2005 | F02M 51/06 |
| EP | 1389274 | B1 | 11/2005 | F02D 41/20 |
| WO | 02/084102 | A1 | 10/2002 | F02M 51/06 |
| WO | 02/095215 | A1 | 11/2002 | F02M 51/06 |
| WO | 2013/167597 | A1 | 11/2013 | F02M 51/06 |

OTHER PUBLICATIONS

International Search Report and Written Opinion, Application No. PCT/EP2013/059499, 10 pages, Jun. 7, 2013.
European Office Action, Application No. 13720954.0, 4 pages, Nov. 16, 2016.
Chinese Office Action, Application No. 201380036501.9, 14 pages, May 3, 2016.

* cited by examiner

VALVE ASSEMBLY FOR AN INJECTION VALVE AND INJECTION VALVE

CROSS-REFERENCE TO RELATED APPLICATIONS

This application is a U.S. National Stage application of International Application No. PCT/EP2013/059499 filed May 7, 2013, which designates the United States of America, and claims priority to EP Application No. 12167049.1 filed May 8, 2012, the contents of which are hereby incorporated by reference in their entirety.

TECHNICAL FIELD

The invention relates to a valve assembly for an injection valve and an injection valve.

BACKGROUND

Injection valves are in wide spread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter and also various elements of the injection valve being responsible for the way the fluid is dosed may vary in a wide range. In addition to that, injection valves may accommodate an actuator for actuating a needle of the injection valve, which may, for example, be an electromagnetic actuator or a piezo electric actuator.

In order to enhance the combustion process in view of the creation of unwanted emissions, the respective injection valve may be suited to dose fluids under very high pressures. The pressures may be in case of a gasoline engine, for example, in the range of up to 200 bar and in the case of diesel engines in the range of more than 2000 bar.

SUMMARY

One embodiment provides a valve assembly for an injection valve, comprising: a valve body having a central longitudinal axis, the valve body comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, an electro-magnetic actuator unit being designed to actuate the valve needle, the electro-magnetic actuator unit comprising an armature axially movable in the cavity, and a disc element being arranged in the cavity and being fixedly coupled to the valve needle, the disc element extending in radial direction of the valve needle to limit axial displacement of the armature relative to the valve needle in axial direction towards the fluid outlet portion, wherein the valve assembly further comprises an armature spring which is operable to bias the armature in direction away from the disc element for establishing a fluid-filled gap between the armature and the disc element, and wherein the armature is axially displaceable relative to the valve needle towards the disc element against the bias of the armature spring for reducing an axial size of the gap.

In a further embodiment, the armature has a planar lower surface facing the fluid outlet portion and the disc element has a upper planar surface facing the lower surface of the armature for establishing the fluid-filled gap, and the lower surface of the armature and the upper surface of the disc element are orientated coplanar to each other.

In a further embodiment, the lower surface of the armature and the upper surface of the disc element are unperforated.

In a further embodiment, the valve assembly further comprises a retainer which is operable to limit axial displacement of the armature relative to the valve needle in direction away from the fluid outlet portion.

In a further embodiment, the retainer is fixedly coupled to the valve needle or in one piece with the valve needle.

In a further embodiment, the armature spring is operable to force the armature into contact with the retainer.

In a further embodiment, the retainer and the disc element are arranged on opposite sides of the armature.

In a further embodiment, a maximum axial size of the fluid-filled gap is 100 μm or less.

In a further embodiment, the disc element is a deep drawn component.

Another embodiment provides an injection valve including a valve assembly as disclosed above.

BRIEF DESCRIPTION OF THE DRAWINGS

Example embodiments and aspects of the valve assembly are described below with reference to the figures, in which.

DETAILED DESCRIPTION

Figure 1:
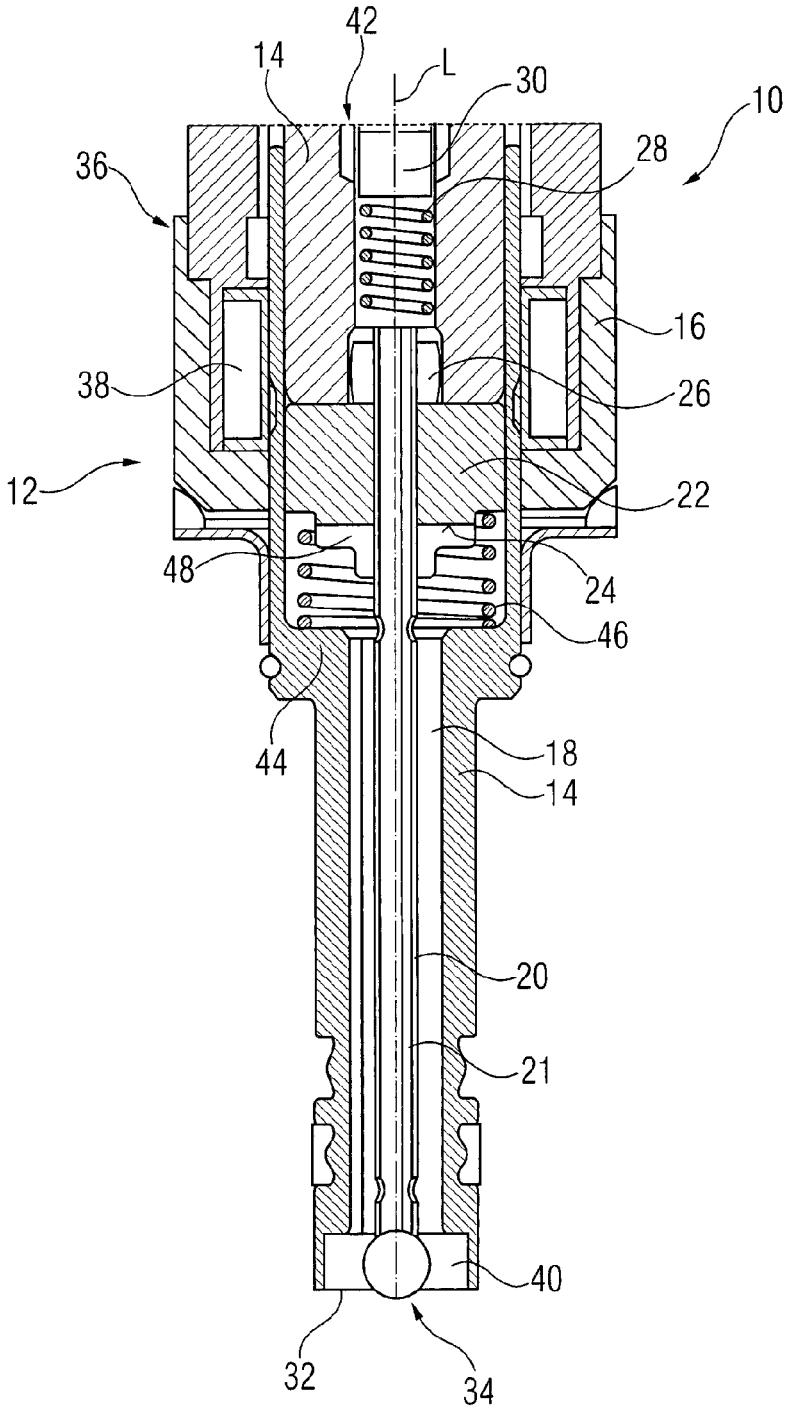
FIG. 1 shows an injection valve with a valve assembly in a longitudinal section view.

Embodiments of the invention provide a valve assembly which facilitates a reliable and precise function.

Some embodiments provide a valve assembly including a valve body having a central longitudinal axis. The valve body comprises a cavity with a fluid inlet portion and a fluid outlet portion. The valve assembly comprises a valve needle axially movable in the cavity. The valve needle prevents a fluid flow through the fluid outlet portion in a closing position and releases the fluid flow through the fluid outlet portion in further positions. The valve assembly comprises an electro-magnetic actuator unit being designed to actuate the valve needle. The electro-magnetic actuator unit comprises an armature axially movable in the cavity relative to the valve body and relative to the valve needle. A disc element is arranged in the cavity and is fixedly coupled to the valve needle. The disc element extends in radial direction of the valve needle to limit the axial movement of the armature relative to the valve needle.

The disc element is in particular operable to limit the axial displacement of the armature relative to the valve needle in direction towards the fluid outlet portion, for example by means of mechanical interaction of the armature and the disc element via a surface portion of the armature which faces towards the fluid outlet portion and a surface portion of the disc element which faces away from the fluid outlet portion.

These surface portions are denoted as "lower surface of the armature" and "upper surface of the disc element", respectively, in the following.

In one embodiment, the valve assembly comprises a retainer. The retainer is operable to limit axial displacement of the armature relative to the valve needle in direction away from the fluid outlet portion. In particular, the retainer is fixedly coupled to the valve needle or in one piece with the valve needle. The retainer and the disc element are preferably positioned at opposite sides of the armature.

The armature may be operable to mechanically interact with the valve needle via the retainer for displacing the valve needle away from the closing position. For example, for moving the valve needle out of the closing position, the armature and the retainer may be designed to establish a form-fit connection between a surface of the retainer which faces towards the fluid outlet portion and a surface of the armature which faces away from the fluid outlet portion. In one development, the retainer may interact with the valve body for guiding the valve needle in axial direction within the valve body.

In one embodiment, the valve assembly comprises an armature spring which is operable to bias the armature in direction away from the disc element for establishing a fluid-filled gap between the armature and the disc element. The armature spring may preferably also be operable to bias the armature in direction away from the fluid outlet portion for forcing the armature in contact with the retainer. The gap is in particular established between the lower surface of the armature and the upper surface of the disc element.

The valve assembly in particular comprises a main spring interacting with the valve needle and/or with the retainer for biasing the valve needle towards the fluid outlet portion. The force balance between the main spring and the armature spring is selected such that the valve needle remains in the closing position when the actuator unit is de-energized.

The armature is axially displaceable with respect to the valve needle towards the disc element against the bias of the armature spring to reduce an axial size of the gap and in particular to squeeze fluid out of the gap in radial direction. In one embodiment, a maximum axial size the size of the gap—i.e. in particular the axial size of the gap when the armature abuts the retainer—is 100 μm or less. The axial size of the gap is in particular the distance between the lower surface of the armature and the upper surface of the disc element.

This has the advantage that during the movement of the valve needle into its closing position the maximum axial displacement of the armature may be limited by the disc element. Kinetic energy of the armature may be efficiently dissipated by means of the fluid being squeezed out of the gap between the armature and the disc element. Therefore, the dynamic of the armature may be damped. Consequently, when the valve needle is moving in its closing position a bouncing of the armature and a bouncing of the valve needle may be avoided. Consequently, an unwanted fluid flow through the fluid outlet portion may be prevented.

In one embodiment, the armature has a planar surface—in particular being represented by the lower surface of the armature—facing the fluid outlet portion. The disc element has a planar surface—in particular being represented by the upper surface of the disc element—facing the surface of the armature. In one embodiment, the lower surface of the armature and the upper surface of the disc element are co-planar, each having in particular a surface normal which is parallel to the longitudinal axis. In one embodiment, the armature and the disc element are designed to establish a form-fit connection between the lower surface of the armature and the upper surface of the disc element. In one embodiment, the lower surface of the armature and the upper surface of the disc element are unperforated.

This has the advantage that during the movement of the valve needle into its closing position the dynamic of the armature can be limited or damped by a compression and/or squeezing of fluid being located between the surface of the armature and the surface of the disc element. In this way, a particular efficient dissipation of kinetic energy of the armature is achievable. Therefore, the bouncing of the armature and the bouncing of the valve needle can be avoided. Furthermore, during the movement of the valve needle out of its closing position the dynamic of the armature can be limited or damped by a sticking effect caused by the adhesion between the plane surface of the armature and the plane surface of the disc element.

In a further embodiment the disc element is a deep drawn component. This has the advantage that the disc element may be manufactured in a very economic manner.

Other embodiments provide an injection valve with a valve assembly as disclosed herein.

Referring to FIG. 1, an injection valve 10 that is in particular suitable for dosing fuel to an internal combustion engine comprises in particular a valve assembly 12. The valve assembly 12 comprises a valve body 14 with a central longitudinal axis L. A housing 16 is partially arranged around the valve body 14. The valve body 14 comprises a cavity 18. The cavity 18 has a fluid outlet portion 40. The fluid outlet portion 40 communicates with a fluid inlet portion 42 which is provided in the valve body 14. The fluid inlet portion 42 and the fluid outlet portion 40 are in particular positioned at opposite axial ends of the valve body 14.

The cavity 18 takes in a valve needle 20. The valve needle 20 is hollow and has a recess 21 which extends in direction of the central longitudinal axis L over a portion of the axial length of the valve needle 20 or over the whole axial length of the valve needle 20.

The valve assembly 12 comprises an armature 22. The armature 22 is axially movable in the cavity 18. The armature 22 is separate from the valve needle 20 and is axially movable relative to the valve needle 20 and to the valve body 14. The armature 22 has a lower surface 24 which faces towards the fluid outlet portion 40.

Furthermore, the valve assembly 12 comprises a retainer 26. The retainer 26 is formed as a collar around the valve needle 20 and is fixedly coupled to the valve needle 20. Alternatively, the retainer 26 may be in one piece with the valve needle, for example the valve needle 20 may have a shaft portion and a collar portion, representing the retainer 26, at an end of the shaft which faces towards the fluid inlet portion 42. The retainer 26 is separate from the armature 22. The retainer 26 interacts with an inner surface of the valve body 14 to guide the valve needle 20 in axial direction inside the valve body 14. For example, the retainer 26 may be in contact, in particular in sliding contact, with the inner surface of the valve body 14 for axially guiding the valve needle 20.

A main spring 28 is arranged in the cavity 18 of the valve body 14. The retainer 26 forms a first seat for the main spring 28. A filter element 30 is arranged in the valve body 14 and forms a further seat for the main spring 28. During the manufacturing process of the injection valve 10 the filter element 30 can be moved axially in the valve body 14 in order to preload the main spring 28 in a desired manner. By this the main spring 28 exerts a force on the valve needle 20 towards an injection nozzle 34 of the injection valve 10.

In a closing position of the valve needle 20 it sealingly rests on a seat plate 32 having at least one injection nozzle 34. The fluid outlet portion 40 is arranged near the seat plate 32. In the closing position of the valve needle 20 a fluid flow through the at least one injection nozzle 34 is prevented. The injection nozzle 34 may be, for example, an injection hole. However, it may also be of some other type suitable for dosing fluid.

The valve assembly 12 is provided with an actuator unit 36 that is preferably an electro-magnetic actuator. The electro-magnetic actuator unit 36 comprises a coil 38, which is preferably arranged inside the housing 16. Furthermore, the electro-magnetic actuator unit 36 comprises the armature 22. The housing 16, parts of the valve body 14 and the armature 22 are forming an electromagnetic circuit.

A step 44 is arranged inside the valve body 14. An armature spring 46 is arranged in the cavity 18. The step 44 forms a seat for the armature spring 46. In other words, the cavity 18 has a step 44 which forms a seat for the armature spring 46. The armature spring 46 is preferably a coil spring.

Figure 2:
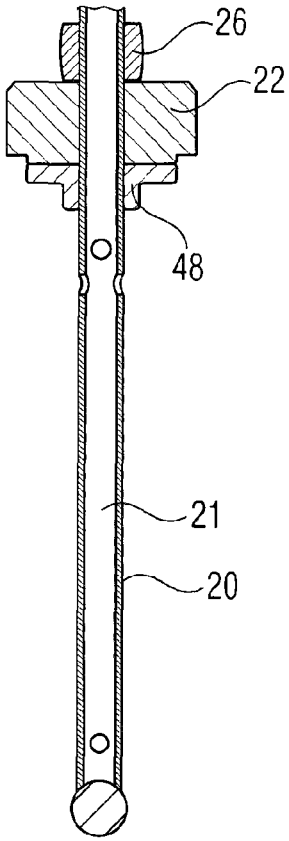
FIG. 2 shows a first embodiment of the valve assembly in a longitudinal section view.
Figure 3:
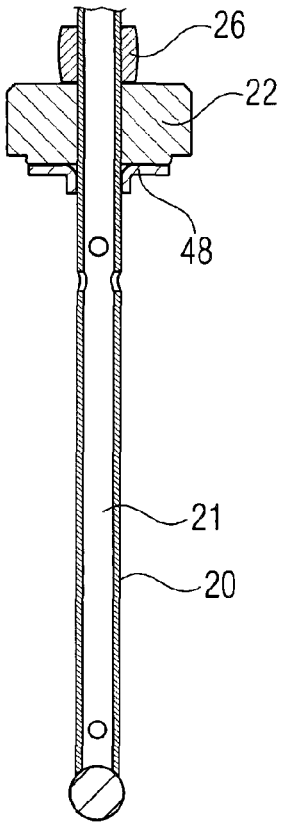
FIG. 3 shows a further embodiment of the valve assembly in a longitudinal section view.

FIGS. 2 and 3 show parts of the valve assembly 12. The valve assembly 12 has a disc element 48. In one preferred embodiment, the disc element 48 is a turned part (FIG. 2). In a further preferred embodiment, the disc element 48 is a deep drawn component (FIG. 3). The disc element 48 is arranged in the cavity 18. The disc element 48 is fixedly coupled to the valve needle 20. The disc element 48 extends in radial direction of the valve needle 20. The retainer 26 and the disc element 28 are positioned in such fashion that the armature 22 is axially displaceable relative to the valve needle 20 between the retainer 26 and the disc element 28, for example by at least 50 μm.

Figure 4:
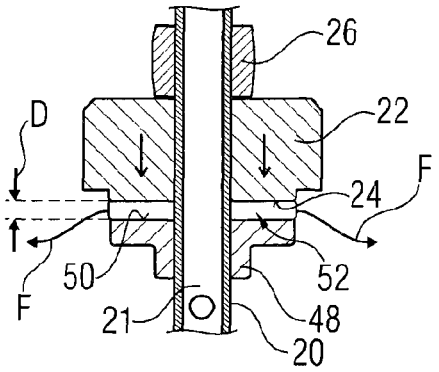
FIG. 4 shows an enlarged view of the valve assembly.
Figure 5:
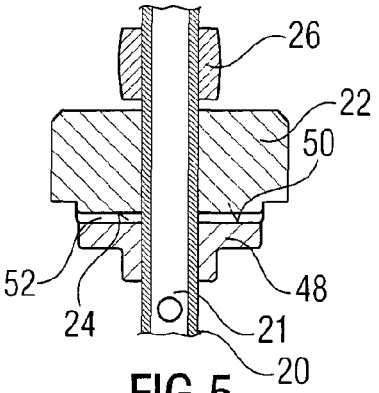
FIG. 5 shows a further enlarged view of the valve assembly.

As shown in FIGS. 4 and 5 the disc element 48 has an upper surface 50 which faces the lower surface 24 of the armature 22, i.e. the upper surface 50 of the disc element 48 faces away from the fluid outlet portion 40. Preferably, the lower surface 24 of the armature 22 and the upper surface 50 of the disc element 48 are planar surfaces. The lower surface 24 of the armature 22 and the upper surface 50 of the disc element 48 are preferably orientated coplanar to each other. Particularly preferably, the lower surface 24 of the armature 22 and the upper surface 50 of the disc element 48 are congruent in top view along the longitudinal axis L.

The armature spring 46 is operable to bias the armature 22 in contact with the retainer 26, in axial direction away from the fluid outlet portion and away from the disc element 28 for establishing a fluid-filled gap 52 between the armature 22 and the disc element 28.

In the following, the function of the injection valve 10 is described in detail:

The fluid is led from the fluid inlet portion 42 towards the fluid outlet portion 40 via the cavity 18 of the valve body 14 and the recess 21 of the valve needle 20.

The valve needle 20 prevents a fluid flow through the fluid outlet portion 40 in the valve body 14 in a closing position of the valve needle 20. Outside of the closing position of the valve needle 20, the valve needle 20 enables the fluid flow through the fluid outlet portion 40. More specifically, a tip portion of the valve needle mechanically interacts with the seat plate 32 for sealing and unsealing the injection nozzle 34. The tip portion may comprise a sealing element for interacting with the seat plate 32. The sealing element may be ball-shaped, for example (see FIGS. 1 to 3).

When the injection valve 10 is at rest with the electro-magnetic actuator unit 36 being de-energized, the main spring 28 biases the valve needle 20 towards the fluid outlet portion 40 and forces the valve needle 20 in contact with the seat plate 32 so that the valve needle 20 is in the closing position. The armature 22 is biased in axial direction away from the fluid outlet portion 40 by the armature spring 46 and thus forced in contact with the retainer 26. The retainer 26 limits axial movement of the armature 22 relative to the valve needle 20 in direction away from the fluid outlet portion 40. The main spring 28 has a larger stiffness than the armature spring 46, so that the armature spring 46 alone is inoperable to move the valve needle 20 out of the closing position.

It is depending on the force balance between the force on the valve needle 20 caused by the actuator unit 36 with the coil 38 and the force on the valve needle 20 caused by the main spring 28 whether the valve needle 20 is in its closing position or not. In the case when the electro-magnetic actuator unit 36 with the coil 38 gets energized the coil 38 may effect a electro-magnetic force on the armature 22. The armature 22 is attracted by the coil 38 and moves in axial direction away from the fluid outlet portion 40. Since the retainer 26 limits axial movement of the armature 22 relative to the valve needle 20 in direction away from the fluid outlet portion 40, the armature 22 takes the valve needle 20 with it so that the valve needle 20 moves in axial direction out of the closing position against the bias of the main spring 28.

Outside of the closing position of the valve needle 20, a gap is established between the valve body 14 and the valve needle 20 at the axial end of the injection valve 10 facing away from of the actuator unit 36, the gap forming a fluid path and fluid can pass through the injection nozzle 34. In other words, outside of the closing position, the valve needle 20 is not in contact with the seat plate 32 so that the injection nozzle 34 is unsealed for dispensing fluid from the valve assembly (12). Fluid can flow from the fluid inlet portion 42 to the recess 21 of the valve needle 20, further through the channels between the recess 21 of the valve needle 20 and the cavity 18 of the valve body 14 to the fluid outlet portion 40.

In the case when the actuator unit 36 is de-energized the main spring 28 can force the retainer 26 and the valve needle 20 to move in axial direction towards the fluid outlet portion 40 until the closing position of the valve needle 20 is reached. During the closing of the valve needle 20 the armature 22 can move relative to the valve needle 20 and the retainer 26 in axial direction and can detach from the retainer 26 to travel further towards the fluid outlet portion 40. The movement of the armature 22 towards the fluid outlet portion 40 relative to the valve needle 20 is decelerated by the armature spring 46 which finally forces the armature 22 to come again into contact with the retainer 26.

More specifically, during the closing of the valve needle 20, i.e. during the axial movement of the valve needle 20 relative to the valve body 14 towards the closing position, the retainer 26 takes the armature 22 with it. When the valve needle 20 reaches the seat plate 32, the axial movement of the valve needle 20 stops. The armature 22 continues its movement—in direction towards the fluid outlet portion 40 relative to the valve needle 20 and to the valve body 13—thereby compressing the armature spring 46, which bears on the step 44 of the cavity 18 with one of its axial ends and bears against the armature 22 with the other axial end.

By compression of the armature spring 46, a first portion of the kinetic energy of the moving armature 22 is converted into potential energy of the armature spring 46. In the following the potential energy stored in the armature spring 46 enables a movement of the armature 22 in the opposite direction, i.e. away from the fluid outlet end 40 with respect to the valve needle 20 and the valve body 14, towards the retainer 26.

The disc element 48 allows a dissipation of a second portion of the kinetic energy of the moving armature 22. The disc element 48 is mounted in a manner that a predetermined distance D of the disc element 48 from the armature 22—in particular between the lower surface 24 of the armature 22 and the upper surface 50 of the disc element 48—may be obtained. The predetermined distance is in particular obtained when the armature 22 is in contact with the retainer 26 (see FIG. 4). Preferably, the distance D is in the range of about 70-100 μm. In other words, the predetermined distance D is in particular a maximum axial size of a fluid-filled gap between the armature 22 and the disc element 48.

Due to that, the armature 22 is able to move between the retainer 26 and the disc element 48. During the closing operation, after the valve needle 20 has come into contact with the seat plate 32, the armature 22 continues its movement in a direction to the upper surface 50 of the disc element 48 thereby compressing the fluid layer 52 which is located between the disc element 48 and the armature 42. The axial size of the fluid-filled gap 52 is reduced in this way. Kinetic energy of the armature 22 is thereby dissipated by means of transfer to the fluid layer 52. The fluid layer 52 exits at least partially from the gap between the disc element 48 and the armature 22 into a fluid flow direction F (FIG. 4). In particular, fluid is squeezed out of the gap in radial direction. Due to the displacement of the fluid layer 52, the kinetic energy of the armature 22 may be reduced in a manner that when the armature spring 46 pushes the armature 22 to its initial closing position, in contact with the retainer 26, the armature 22 may hit the retainer 26 particularly gently so that a reopening of the injection valve 10 may be avoided.

The main advantage of the presented valve assembly 12 is that due to the disc element 48 bouncing and post-injection operations of the injection valve 10 may be avoided. The armature 22 may move to its initial closing position in an early stage of the closing operation. Therefore, multiple injections of the injection valve 10 may be carried out with small delays between two successive injection processes.

Additionally, an overshoot of the valve needle 20 can be reduced during the opening operation of the valve needle 20. More specifically, when the armature 22 stops moving towards the fluid inlet portion 42 at the end of its opening transient, the valve needle 20 decouples from the retainer 26 and moves further toward the fluid inlet portion 42 with respect to the valve body 14 and the armature 22 against the bias of the main spring 28. This relative movement of the valve needle 20 with respect to the armature 22 reduced the axial size of the gap between the upper surface 50 of the disc element 48 and the lower surface 24 of the armature 22, in analogous manner as described previously. Thus, a portion of the kinetic energy of the valve needle 20 is dissipated by fluid being squeezed out of the gap in radial direction. Therefore, the valve needle 20 is decelerated faster than by the main spring 28 alone so that the overshoot of the valve needle 20 is reduced.

What is claimed is:

1. A valve assembly for an injection valve, comprising:

a valve body and comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, an electro-magnetic actuator unit configured to actuate the valve needle, the electro-magnetic actuator unit comprising a cylindrical armature axially movable in the cavity, and a disc element arranged in the cavity and being fixedly coupled to the valve needle, the disc element comprising an L-shaped cross-section having an axially extending leg and a radially extending leg facing the cylindrical armature, the disc element extending radially to limit axial displacement of the cylindrical armature relative to the valve needle in an axial direction towards the fluid outlet portion, the cylindrical armature having a primary radius greater than a radius of the radially extending leg of the disc element and a stepdown to a secondary radius equal to the radius of the radially extending leg of the disc element, and an armature spring that biases the armature away from the disc element to thereby establish a fluid-filled gap between the armature and the radially extending leg of the disc element, wherein the armature is axially displaceable relative to the valve needle towards the disc element against the bias provided by the armature spring to reduce an axial size of the gap until the armature and the disc element are in direct contact.

2. The valve assembly of claim 1, wherein:

the armature has a planar lower surface on the stepdown of the cylindrical armature facing the fluid outlet portion, the disc element has an upper planar surface facing the lower surface of the armature for establishing the fluid-filled gap, the lower surface of the armature and the upper surface of the disc element are orientated coplanar to each other.

3. The valve assembly of claim 2, wherein the lower surface of the armature and the upper surface of the disc element are unperforated.

4. The valve assembly of claim 1, further comprising a retainer configured to limit axial displacement of the armature relative to the valve needle in direction away from the fluid outlet portion.

5. The valve assembly of claim 4, wherein the retainer is fixedly coupled to the valve needle or in one piece with the valve needle.

6. The valve assembly of claim 4, wherein the armature spring is operable to force the armature into contact with the retainer.

7. The valve assembly of claim 4, to wherein the retainer and the disc element are arranged on opposite sides of the armature.

8. The valve assembly of claim 4, wherein a maximum axial size of the fluid-filled gap is 100.mu.m or less.

9. The valve assembly of claim 1, wherein the disc element is a deep drawn component.

10. An injection valve, comprising: a valve assembly comprising:

a valve body and comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, an electro-magnetic actuator unit configured to actuate the valve needle, the electromagnetic actuator unit comprising a cylindrical armature axially movable in the cavity, and a disc element arranged in the cavity and being fixedly coupled to the valve needle, the disc element comprising an L-shaped cross-section having an axially extending leg and a radially extending leg, the disc element extending radially to limit axial displacement of the cylindrical armature relative to the valve needle in an axial direction towards the fluid outlet portion, a retainer in sliding contact with an inner surface of the valve body for axially guiding the valve needle, the retainer including a collar around the valve needle, the collar forming a seat for a main spring biasing the valve needle toward the fluid outlet portion, the cylindrical armature having a primary radius greater than a radius of the radially extending leg of the disc element and a stepdown to a secondary radius equal to the radius of the radially extending leg of the disc element, and an armature spring that biases the cylindrical armature away from the disc element to thereby establish a fluid-filled gap between the cylindrical armature and the radially extending leg of the disc element, wherein the cylindrical armature is axially displaceable relative to the valve needle towards the disc element against the bias provided by the armature spring to reduce an axial size of the gap until the cylindrical armature and the disc element are in direct contact.

11. The injection valve of claim 10, wherein:

the armature has a planar lower surface on the stepdown of the cylindrical armature facing the fluid outlet portion, the disc element has a upper planar surface facing the lower surface of the armature for establishing the fluid-filled gap, the lower surface of the armature and the upper surface of the disc element are orientated coplanar to each other.

12. The injection valve of claim 11, wherein the lower surface of the armature and the upper surface of the disc element are unperforated.

13. The injection valve of claim 10, wherein the valve assembly further comprises a retainer configured to limit axial displacement of the armature relative to the valve needle in direction away from the fluid outlet portion.

14. The injection valve of claim 13, wherein the retainer is fixedly coupled to the valve needle or in one piece with the valve needle.

15. The injection valve of claim 13, wherein the armature spring is operable to force the armature into contact with the retainer.

16. The injection valve of claim 13, wherein the retainer and the disc element are arranged on opposite sides of the armature.

17. The injection valve of claim 13, wherein a maximum axial size of the fluid-filled gap is 100.mu.m or less.

18. The injection valve of claim 10, wherein the disc element is a deep drawn component.

19. A valve assembly for an injection valve, comprising:

a valve body having a central longitudinal axis and comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, an electro-magnetic actuator unit to actuate the valve needle, the electro-magnetic actuator unit comprising an armature axially movable in the cavity, and a disc element arranged in the cavity and fixedly coupled to the valve needle, the disc element comprising an L-shaped cross-section having an axially extending leg and a radially extending leg, the disc element extending radially to limit axial displacement of the armature relative to the valve needle in an axial direction towards the fluid outlet portion, the armature extending radially beyond the radially extending leg of the disc element, wherein the cylindrical armature and the disc element do not share any axial overlap along the central longitudinal axis, and an armature spring biasing the armature away from the disc element to thereby establish a fluid-filled gap between the armature and the disc element, wherein the fluid-filled gap is disposed between a lower surface of the armature facing the fluid outlet portion of the cavity and the radially extending leg of the disc element forming an upper surface of the disc element facing the lower surface of the armature, the lower surface of the armature and the upper surface of the disc element are not perforated, and the armature is displaceable along the longitudinal axis of the valve needle towards the disc element against the bias provided by the armature spring to reduce an axial size of the gap by squeezing fluid out of the gap in a radial direction and thereby dissipating kinetic energy of the armature.

* * * * *